US007797952B2

(12) United States Patent
Lee et al.

(10) Patent No.: US 7,797,952 B2
(45) Date of Patent: Sep. 21, 2010

(54) DEFROSTING METHOD OF DRUM-TYPE WASHING MACHINE

(75) Inventors: Soon Jo Lee, Changwon-si (KR); Ho Cheol Kwon, Changwon-si (KR); Beom Jun Kim, Changwon-si (KR); Hyun Soo Kim, Changwon-si (KR); Hack Chai Song, Changwon-si (KR); Kwang Young Lee, Changwon-si (KR); Eun Suk Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 266 days.

(21) Appl. No.: 11/828,037

(22) Filed: Jul. 25, 2007

(65) Prior Publication Data

US 2008/0028772 A1 Feb. 7, 2008

(30) Foreign Application Priority Data

Jul. 26, 2006 (KR) ..... 10-2006-0070803

(51) Int. Cl.
*F25D 21/00* (2006.01)

(52) U.S. Cl. ..... 62/80; 62/82; 68/12.12

(58) Field of Classification Search ..... 62/80, 62/82; 68/12.12

See application file for complete search history.

(56) References Cited

U.S. PATENT DOCUMENTS

| | | | | | |
|---|---|---|---|---|---|
| 2,300,085 | A | * | 10/1942 | Yunker | 62/82 |
| 4,766,734 | A | * | 8/1988 | Dudley | 62/160 |
| 5,924,298 | A | * | 7/1999 | Yoo | 62/153 |
| 6,255,952 | B1 | | 7/2001 | Jang | |
| 2003/0230094 | A1 | * | 12/2003 | Takano | 62/150 |

FOREIGN PATENT DOCUMENTS

| | | | |
|---|---|---|---|
| JP | 04-129597 | | 4/1992 |
| KR | 10-2005-0050302 | * | 5/2005 |
| KR | 10-2006-0012437 | A | 2/2006 |

OTHER PUBLICATIONS

KR 10-2005-0050302 translation; Kim, Gyeong-Hak; published on May 31, 2005.*
Chinese Office Action dated Mar. 27, 2009.
German Office Action issued in DE Application No. 102007035066.1 dated Apr. 7, 2010.

* cited by examiner

*Primary Examiner*—Cheryl J Tyler
*Assistant Examiner*—Justin Loffredo
(74) *Attorney, Agent, or Firm*—KED & Associates, LLP

(57) ABSTRACT

A defrosting method of a drum-type washing machine is provided. The defrosting method includes performing a warm water supply operation upon receiving a defrost command; performing a water discharge operation; performing a heating operation if a water level has not yet decreased; and performing an additional water discharge operation.

16 Claims, 7 Drawing Sheets

DEFROSTING METHOD OF DRUM-TYPE WASHING MACHINE

This application claims priority from Korean Patent Application No. 10-2006-0070803 filed on Jul. 27, 2006 in the Korean Intellectual Property Office, the disclosure of which is incorporated herein by reference in its entirety.

BACKGROUND OF THE INVENTION

1. Field of the Invention

The present invention relates to a defrosting method of a drum-type washing machine, and more particularly, to a defrosting method of a drum-type washing machine in which a drum-type washing machine, and particularly, a pump casing in the drum-type washing machine, can be quickly defrosted by supplying water and heating the water.

2. Description of the Related Art

Washing machines are devices for removing dust and dirt from laundry using a detergent and water. Washing machines are largely classified into agitator-type washing machines, pulsator-type washing machines, and drum-type washing machines.

Agitator-type washing machines wash laundry by laterally rotating an agitator in a washing tub, pulsator-type washing machine wash laundry by laterally rotating a disc-shaped pulsator or a washing tub and thus causing friction between wash water and the laundry, and drum-type washing machines wash laundry by rotating a drum with the use of a lifter and thus lifting up or down the laundry.

A drum-type washing machine includes a pump unit which pumps out water in a tub and is connected to the tub through a water discharge bellows tube. The pump unit includes a pump casing which is connected to the water discharge bellows tube and accommodates a filter so that the filter can be easily attached to or detached from the pump casing; a water discharge pump which pumps out water in the pump casing; and a water discharge hose which guides the water pumped out by the water discharge pump to the outside of the drum-type washing machine.

Conventionally, frost is likely to be generated in a drum-type washing machine (particularly, in a pump casing) due to a water load test of the drum-type washing machine or due to cold weather. In this case, a drum-type washing machine may not be able to properly discharge water and may thus malfunction, thereby reducing the reliability.

In order to defrost a drum-type washing machine, a user may pour boiling water into the drum-type washing machine. In this case, however, the user may get burned and feel inconvenience.

SUMMARY OF THE INVENTION

The present invention provides a defrosting method of a drum-type washing machine in which a drum-type washing machine can be quickly defrosted by supplying water and heating the water in response to a defrost command.

According to an aspect of the present invention, there is provided a defrosting method of a drum-type washing machine, the defrosting method including performing a warm water supply operation upon receiving a defrost command from a user; and performing a water discharge operation.

The defrosting may also include notifying the user of completion of a defrost operation if a water level has decreased.

The performing the water discharge operation, may include performing the water discharge operation for a predefined amount of time.

If the water level has not yet decreased, the defrosting method may also include performing a heating operation; and performing an additional water discharge operation during or after the heating operation.

If the water level has reached a predetermined value within a predefined amount of time after the commencement of the warm water supply operation, the defrosting method may also include performing the water discharge operation.

The predetermined value may be determined so that a heater can be soaked in warm water supplied during the warm water supply operation.

The performing the additional water discharge operation, may include performing the additional water discharge operation for a predefined amount of time.

The defrosting method may also include performing the heating operation and the additional water discharge operation repeatedly if the water level has not yet decreased.

The performing the heating operation and the additional water discharge operation repeatedly, may include increasing a target heating temperature by a predefined amount whenever performing the heating operation.

The increasing the target heating temperature, may include increasing the target heating temperature up to a predefined maximum temperature.

According to another aspect of the present invention, there is provided a defrosting method of a drum-type washing machine, the defrosting method including performing a warm water supply operation upon receiving a defrost command from a user; if a water level has not reached a predetermined value within a predefined amount of time after the commencement of the warm water supply operation, performing a cold water supply operation; if the water level has reached the predetermined value within the predefined amount of time after the commencement of the cold water supply operation, performing a heating operation; and performing a water discharge operation.

The predetermined value may be determined so that a heater can be soaked in water supplied during either the warm water supply operation or the cold water supply operation.

The defrosting method may also include notifying the user of completion of a defrost operation if a water level has decreased.

The defrosting method may also include performing the heating operation and the water discharge operation repeatedly if the water level has not yet decreased.

The defrosting method may also include, after the performing the heating operation and the water discharge operation repeatedly, notifying the user of completion of a defrost operation if the water level has decreased.

The performing the heating operation and the water discharge operation repeatedly, may include increasing a target heating temperature by a predefined amount whenever performing the heating operation.

The increasing the target heating temperature, may include increasing the target heating temperature up to a predefined maximum temperature.

The performing the water discharge operation, may include performing the water discharge operation for a predefined amount of time.

If the water level has not reached the predetermined value within the predefined amount of time after the commencement of the cold water supply operation, the defrosting method may also include notifying the user of occurrence of a defrost error.

According to another aspect of the present invention, there is provided a defrosting method of a drum-type washing machine, the defrosting method including: performing a water supply operation upon receiving a defrost command from a user; and performing a water discharge operation.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

Figure 1:
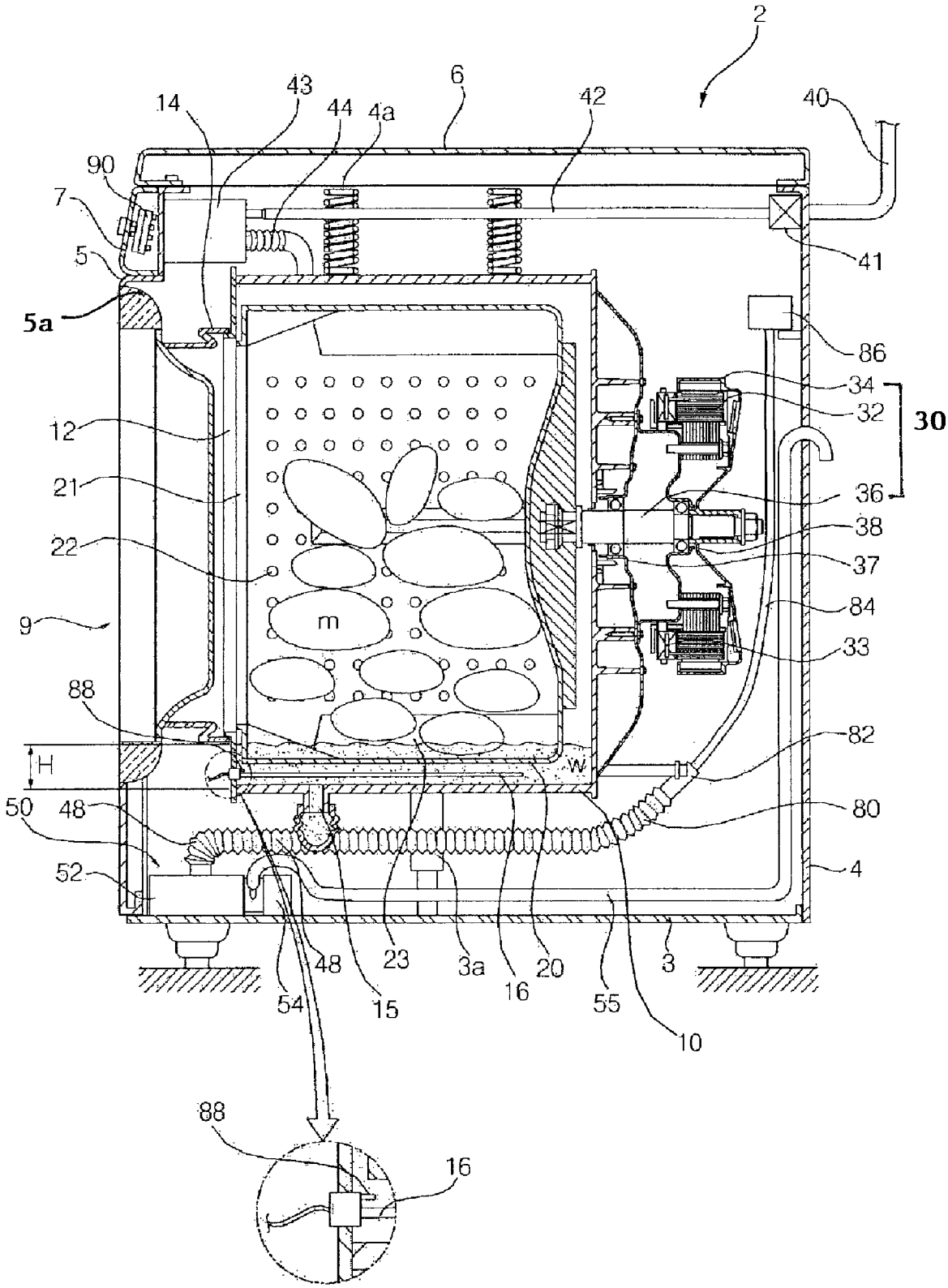
FIG. 1 is a cross-sectional view of a drum-type washing machine to which the present invention can be applied.

FIG. 1 is a cross-sectional view of a drum-type washing machine to which the present invention can be applied. Referring to FIG. 1, the drum-type washing machine includes a casing 2 which defines the exterior of the drum-type washing machine, a tub 10 which is installed in the casing 2, a drum 20 which is contained in the tub 10, and a motor 30 which rotates the drum 20.

The casing 2 includes a base 3, a cabinet 4 which is mounted on the base 3, a cabinet cover 5 which is mounted at the front of the cabinet 4 and includes a laundry inlet/outlet hole 5*a*, and a top plate 6 which is mounted on the cabinet 4.

A door 9 is attached to the cabinet cover 5 so as to be able to rotate. The door 9 opens or closes the laundry inlet/outlet hole 5*a*.

A control panel 7 is mounted on the top plate 6 or on the cabinet cover 5. A user may input signals or commands to the control panel 7 to perform a washing operation, a rinsing operation, and a water discharge operation.

The tub 10 is a container which contains wash water for a washing or rising operation and waste water from laundry m. The tub 10 includes a cylinder which is laid down horizontally or diagonally. An opening hole 12 is formed behind the laundry inlet/outlet hole 5*a* of the cabinet cover 5. A gasket 14 is formed along the circumference of the opening hole 12 and includes a scaling portion that is placed in firm contact with the door 5.

The tub 10 is supported by dampers 4*a* which are disposed at an upper portion of the base 3 and serve as buffers for the tub 10. The tub 10 is also supported by the cabinet 4 and is suspended by a spring 3*a*.

A heater 16 is installed in the tub 10. The heater heats water supplied into the tub 10.

The drum 20 is a washing tub which accommodates the laundry m for performing washing, rinsing, and water discharge operations. The drum 20 is installed in the tub 10, and is spaced apart from the inner surface of the tub 10.

The drum 20 includes a cylinder which is laid down horizontally or diagonally at the front of the drum 20; a laundry inlet/outlet hole 21 which is disposed at the front of the drum 20 and through which the laundry m can be put into the drum 20; and a plurality of water holes 22 which are disposed at the rear of the drum 20 and through which water can flow in and out of the drum 20. A lifter 23 is attached onto the inner circumference of the drum 20. The lifter 23 lifts up or down the laundry m.

The motor 30 includes a fixing element 32 which is attached onto the rear surface of the tub 10, a rotating element 34 which rotates in association with the fixing element 32; and a rotation axial member 36 which is fixed to the rotating element 34 and can thus rotate along with the rotating element 34.

A hall sensor 33 is installed at the fixing element 32. The hall sensor 33 can measure the rotation angle or the revolutions per minute (RPM) of the rotating element 34.

The rotation axial member 36 penetrates through the rear of the tub 10 and is supported by bearings 37 and 38 so as to be able to rotate. The bearings 37 and 38 are attached to the tub 10. A rear end of the rotation axial member 36 is fixed to the rotating element 34, and a front end of the rotation axial member 36 is connected to the rear of the drum 20.

A water supply apparatus is disposed on the tub 10. The water supply apparatus is connected to the tub 10 so that water mixed with a detergent or clean water can be supplied into the tub 10.

The water supply apparatus includes a number of water supply valves 41 which control the supply of clean water provided through the external hose 40; a number of water supply hoses 42 which guide water that pass through the water supply valves 41; a detergent container 43 which contains a detergent and includes a water supply passage and a drain therein so that water supplied through the water supply hoses 42 can be mixed with the detergent in the detergent container 43; and a water supply bellows tube 44 which is connected to the drain of the detergent container 43 and can thus guide the detergent-containing water supplied thereto from the detergent container 43 or clean water to the inside of the tub 10. The water supply bellows tube 44 is also connected to a water supply hole which is disposed on the tub 10.

The water supply apparatus can selectively supply warm water or cold water.

For this, the water supply valves 41 include a cold water supply valve and a warm water supply valve.

The water supply hoses 42 include a cold water supply hose which is connected to the cold water supply valve and a warm water supply hose which is connected to the warm water supply valve.

A cold water passage through which cold water flows and a warm water passage through which warm water flows are formed in the detergent container 43.

When the cold water supply valve is turned on, cold water supplied from an external source is supplied into the tub 10 through the water supply bellows tube 44, sequentially passing through the cold water supply valve, the cold water supply hose, and the cold water passage in the detergent container 43. Likewise, when the warm water supply valve is turned on, warm water supplied from an external source is supplied into the tub 10 through the water supply bellows tube 44, sequentially passing through the warm water supply valve, the warm water supply hose, and the warm water passage in the detergent container 43.

A drain 15 is formed at the bottom of the tub 10. A water discharge bellows tube 48 is connected to the drain 15. The water discharge bellows tube 48 guides water discharged from the tub 10 through the drain 15.

A pump unit 50 is connected to the water discharge bellows tube 48. The pump unit 50 pumps out water discharged from the tub 10 through the drain 15 and the water discharge bellows tube 48 or circulates the water back into the drum 20.

The pump unit 50 includes a pump case 52 and a water discharge pump 54.

Figure 2:
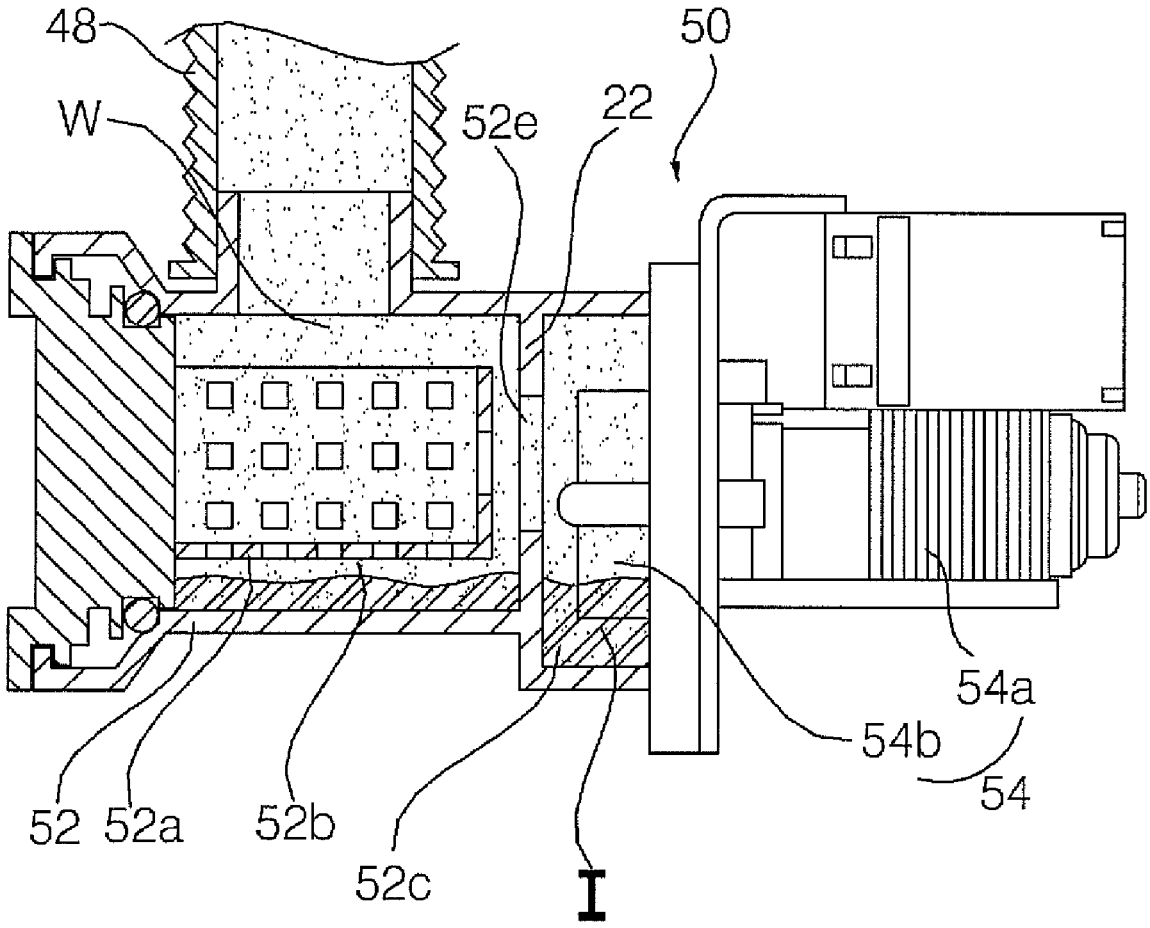
FIG. 2 is an enlarged cross-sectional view of a pump illustrated in FIG. 1.

FIG. 2 is a detailed cross-sectional view of the pump unit 50 illustrated in FIG. 1. Referring to FIG. 2, the pump case 52 includes a connector to which the water discharge bellows tube 48 is connected; a flow channel through which water flows and which is connected to the water discharge pump 54; and a filter 52*a* which filters out waste thread.

The pump case 52 also includes a filter chamber 52*b* which is open at the front of the pump case 52 and accommodates the filter 52*a* so that the filter 52*a* can be easily attached to/detached from the filter chamber 52*b*; and a pump chamber 52*c* which accommodates an impeller 54*b* of the water discharge pump 54.

The pump case 52 also includes a barrier wall 22 which separates the filter chamber 52*b* from the pump chamber 52*c*. A through hole 52*e* is formed through the barrier wall 22 and thus enables water in the filter chamber 52*b* to flow into the pump chamber 52*c*.

The water discharge pump 54 includes a motor 54*a* and the impeller 54*b* which is connected to a rotation axial element of the motor 54*a* and can thus rotate inside the pump chamber 52*c*.

A water discharge hose 55 is connected to the pump unit 50 and extends beyond the outside of the casing 2. The water discharge hose 55 discharges water supplied into the pump case 52 during a water discharge operation performed by the drum-type washing machine.

Referring to FIG. 1, the drum-type washing machine also includes a water level detection apparatus which detects the level of water supplied into the drum-type washing machine. The water level detection apparatus includes a water level detection bellows tube 80 which is connected to the water discharge bellows tube 48; an air chamber 82 which is filled with air and is increasingly pressurized as the water level in the water level detection bellows tube 80 increases; a water level detection tube 84 which has a first end connected to the air chamber 82; and a water level sensor 86 which is connected to a second end of the water detection tube 84 and determines the water level in the water level detection bellows tube 80 by measuring the air pressure in the water level detection tube 84.

A temperature sensor 88 is installed in the tub 10. The temperature sensor 88 detects the temperature of water supplied into the tub 10.

A control unit 90 controls the manipulation of the control panel 7. Also the control unit 90 controls the operations of the heater 16, the motor 30, the water supply valve 42, and the water discharge pump 54 according to the water level detected by the water level sensor 86 and the water temperature detected by the temperature sensor 88.

Figure 3:
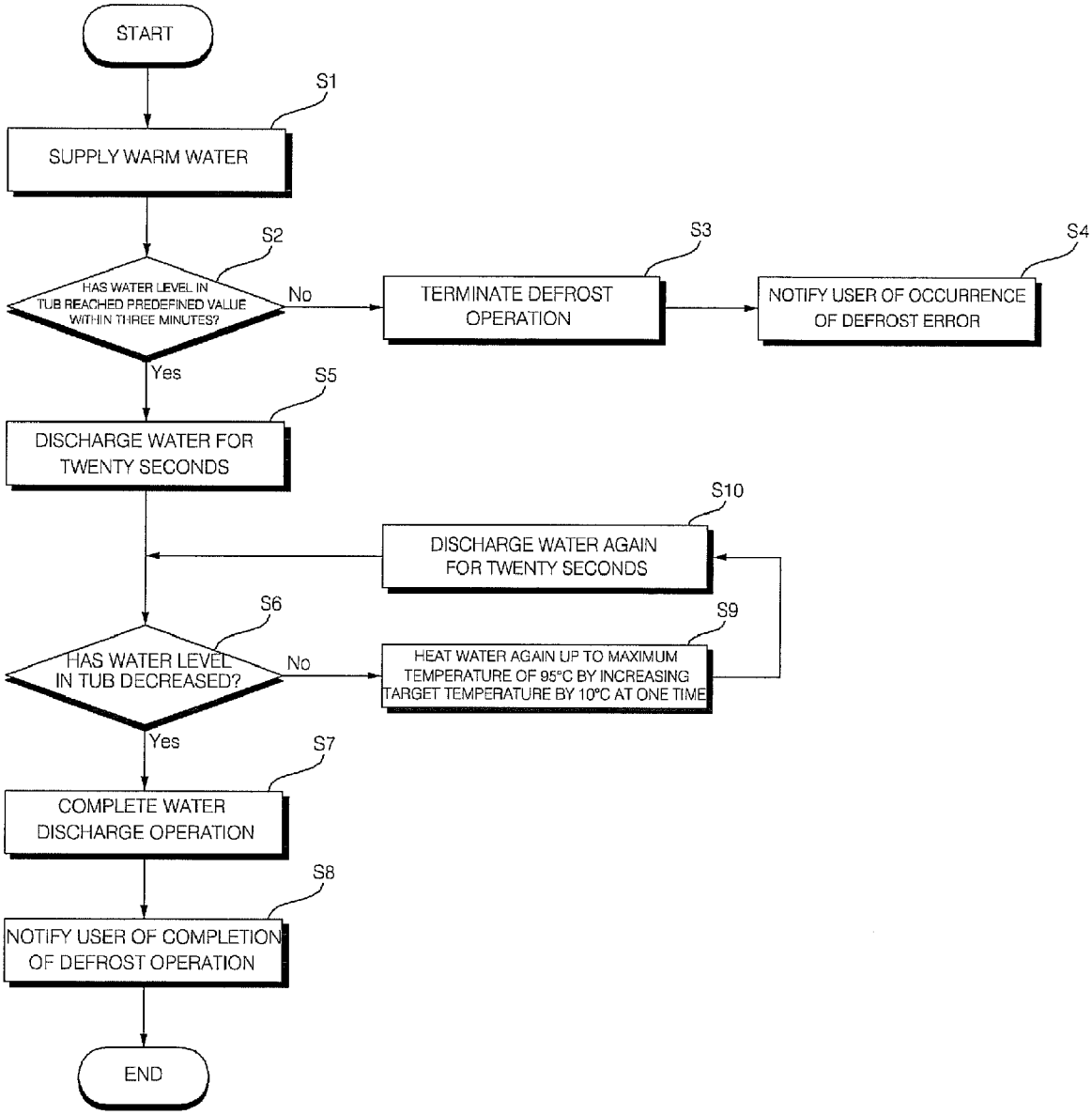
FIG. 3 is a flowchart illustrating a defrosting method of a drum-type washing machine, according to an embodiment of the present invention.

FIG. 3 is a flowchart illustrating a defrosting method of a drum-type washing machine, according to an embodiment of the present invention. Referring to FIG. 3, the defrosting method includes performing a warm water supply operation (S1), performing a water discharge operation (S5), performing a heating operation (S9), and performing an additional water discharge operation (S10).

Referring to FIG. 3, the control unit 90 performs a warm water supply operation upon receiving a defrost command from a user (S1). The user may input the defrost command to the drum-type washing machine by hitting one or more buttons (particularly, a defrost button) on the control panel 7 after supplying power to the drum-type washing machine. However, the present invention is not restricted to this. In other words, the user may input the defrost command to the drum-type washing machine in various manners other than that set forth herein.

The control unit 90 performs the warm water supply operation by turning on the water supply valves 41 (particularly, the warm water supply valve) in response to the defrost command so that warm water can be supplied into the tub 10 via the warm water supply valve (S1).

As warm water is supplied into the tub 10, the pump unit 50, the water discharge bellows tube 48, the drain 15 of the tub 10, and the tub become increasingly filled with the warm water.

Only a lower portion of the pump unit 50 may be frosted due to water remaining therein. Alternatively, the entire pump unit 50, the water discharge bellows tube 48, the drain of the tub 10, and a lower portion of the tub 10 may be frosted due to water remaining therein. For convenience, assume that only the lower portion of the pump unit 50 is frosted due to water remaining therein.

Referring to FIG. 2, frost I in the pump case 52 may be melted by warm water supplied into the pump case 52 during the warm water supply operation.

During the warm water supply operation, the water level sensor 86 may detect the water level in the tub 10, and output the detected water level to the control unit 90. The control unit 90 determines whether the water level in the tub 10 has reached a predefined value H within, for example, three minutes, after the commencement of the warm water supply operation (S2). If it is determined that the water level in the tub 10 has reached the predefined value H within three minutes after the commencement of the warm water supply operation, the control unit 90 completes the warm water supply operation.

The predefined value H may be determined so that the heater 16 can be soaked in the warm water supplied into the tub 10, and that the heating of warm water can be properly performed later in operation S9.

On the other hand, if it is determined that the water level in the tub 10 has not reached the predefined value H within three minutes after the commencement of the warm water supply operation, the control unit 90 determines that the warm water supply operation has not been properly performed, and terminates an entire defrost operation (S3). Then, the control unit 90 notifies the user of the occurrence of a defrost error using a display device (such as a light emitting diode (LED) or a liquid crystal display (LCD)) or an acoustic device (such as a buzzer or a speaker) of the control panel 7 (S4).

If it is determined that the water level in the tub 10 has reached the predefined value H within three minutes after the commencement of the warm water supply operation (S2), the control unit 90 determines that the warm water supply operation has been properly performed. Therefore, the frost I in the pump case 52 may be gradually melted and may thus be mixed with the warm water in the tub 10.

After the warm water supply operation, the control unit 90 performs a water discharge operation (S5).

More specifically, the control unit 90 performs the water discharge operation by supplying power to the water discharge pump 54 (particularly, the motor 54*a*) for, for example, twenty seconds (S5).

If the frost I in the pump case 52 is completely melted away by the warm water supplied into the tub 10, the impeller 54*b* may be able to rotate without being restrained by the frost I. Thus, the impeller 54*b* pumps out the warm water in the tub 10 along with the melting frost so that the warm water in the tub 10 can be discharged through the water discharge bellows tube 48 (S5).

As the water discharge operation proceeds, the water level in the tub 10 gradually decreases. The water level sensor 86 detects the water level in the tub 10 again, and outputs the result of the detection to the control unit 90. Then, the control unit 90 completes the water discharge operation (S7) if it is determined that the water level in the tub 10 has decreased (S6).

Thereafter, the control unit 90 notifies the user that the defrost operation has been completed with the aid of a display device (such as an LED or an LCD) or an acoustic device (such as a buzzer or a speaker) of the control panel 7 (S8).

On the other hand, if the frost I in the pump case 52 still remains yet to be melted, the rotation of the impeller 54*b* may still be restricted by the frost I. Thus, the warm water in the tub 10 may not be able to be discharged properly, and thus, the water level in the tub 10 may not decrease at all.

If it is determined that the water level in the tub 10 has not yet decreased, the control unit 90 may perform a heating operation (S9).

More specifically, the control unit 90 performs the heating operation by supplying power to the heater 16 so that the warm water supplied into the tub 10 can be heated up to a predetermined temperature, for example, a temperature of 65° C., by the heater 16 (S9).

The predetermined temperature may be experimentally determined so that the frost I in the pump case 52 can easily and quickly melt away.

As the heating operation proceeds, the temperature of the cold water in the tub 10 gradually increases, and the temperature of the warm water in the pump case 52 also gradually increases due to heat conduction.

Then, the temperature of the warm water in the pump case 52 is higher after operation S9 than before operation S9, and thus, the frost I in the pump case 52 may easily be melted.

During or after operation S9, the control unit 90 may perform an additional water discharge operation (S10).

In this embodiment, operation S10 is performed after operation S9, i.e., after the cut-off of power to the heater 16.

More specifically, the control unit 90 supplies power to the discharge pump 54 (particularly, the motor 54*a*) for, for example, twenty seconds.

If the frost in the pump case 52 is completely melted away, the impeller 54*b* may be able to rotate without being restrained by the frost I. The impeller 54*b* pumps out melting frost so that the melting frost can be discharged from the tub 10 through the water discharge bellows tube 48 (S10).

On the other hand, if the frost I in the pump case 52 still remains yet to be melted, the rotation of the impeller 54*b* may be restricted by the frost I. As a result, the water in the tub 10 may not be able to be discharged, and thus, the water level in the tub 10 may not decrease at all.

If it is determined that the water level in the tub 10 still has not yet decreased even after operation S10, operations S9 and S10 may be performed repeatedly.

Whenever operation S9 is performed, a target temperature of the heater 16 may be increased by 10° C. The target temperature of the heater 16 may be gradually increased up to, for example, a maximum of 95° C. For example, the target temperature of the heater 16 may be set to 65° C. for a first iteration of operation S9. Thereafter, the target temperature of the heater 16 may be increased to 75° C. for a second iteration of operation S9. Thereafter, the target temperature of the heater 16 may be increased to 85° C. for a third iteration of operation S9. Thereafter, the target temperature of the heater 16 may be increased to a maximum of 95° C. for a fourth iteration (or subsequent iterations) of operation S9.

By performing operations S9 and S10 repeatedly, the frost I in the pump case 52 can be completely melted away. Thus, the impeller 54*b* may pump out the melting frost so that the melting frost can be discharged from the tub 10 through the water discharge bellows tube 48, and that the water level in the tub 10 can decrease.

If it is determined that the water level in the tub 10 has decreased (S 6), the control unit 90 completes the additional water discharge operation (S7), and notifies the user of the completion of the defrost operation with the aid of a display device (such as an LED or an LCD) or an acoustic device (such as a buzzer or a speaker) of the control panel 7 (S8).

Figure 4:
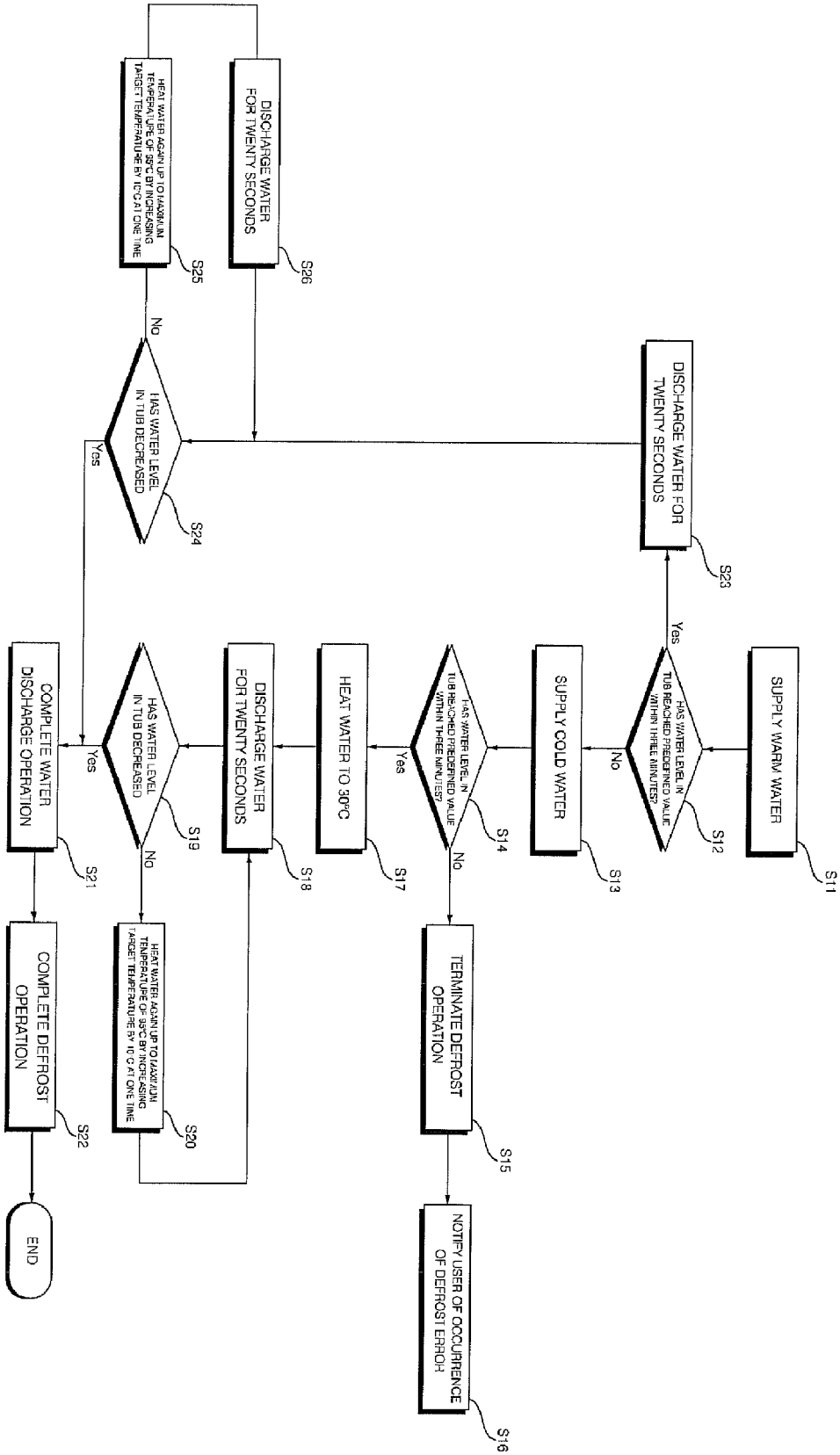
FIG. 4 is a flowchart illustrating a defrosting method of a drum-type washing machine, according to another embodiment of the present invention.

FIG. 4 is a flowchart illustrating a defrosting method of a drum-type washing machine, according to another embodiment of the present invention. Referring to FIG. 4, the defrosting method includes performing a warm water supply operation (S11), performing a cold water supply operation (S13), performing a heating operation (S17), and performing a water discharge operation (S18).

Referring to FIG. 4, the control unit 90 performs a warm water supply operation by turning on the water supply valves 41 (particularly, the warm water supply valve) upon receiving a defrost command from a user so that warm water can be supplied into the tub 10 via the warm water supply valve (S11).

The frost I in the pump case 52 may be gradually melted by the warm water in the pump case 52. During the warm water supply operation, the water level sensor 86 may detect the water level in the tub 10, and output the result of the detection to the control unit 90.

The control unit 90 determines whether the water level in the tub 10 has reached a predefined value H within, for example, three minutes, after the commencement of the warm water supply operation (S12). If it is determined that the water level in the tub 10 has not reached the predefined value H within three minutes after the commencement of the warm water supply operation, the control unit 90 determines that the warm water supply operation has not been properly performed, and performs a cold water supply operation by supplying cold water, instead of warm water, into the tub 10 (S13).

The predefined value H may be determined so that the heater 16 can be soaked in the warm water supplied into the tub 10.

If no warm water has been supplied into the tub 10 in operation S11, the pump case 52 becomes increasingly filled with the cold water supplied into the tub 10. On the other hand, if at least only a small amount of warm water has been supplied into the tub 10 in operation S12, the cold water supplied into the tub 10 may be mixed with the warm water supplied into the tub 10, and the water level in the tub 10 may further increase. For convenience, assume that no warm water has been supplied into the tub 10 in operation S11.

The control unit 90 determines whether the water level in the tub 10 has reached the predefined value H within three minutes after the commencement of the cold water supply operation (S14). If it is determined that the water level in the tub 10 has not yet reached the predefined value H within three minutes after the commencement of the cold water supply operation, the control unit 90 determines that the cold water supply operation also has not been properly performed, and terminates an entire defrost operation (S15). Then, the control unit 90 notifies the user of the occurrence of a defrost error using a display device (such as an LED or an LCD) or an acoustic device (such as a buzzer or a speaker) of the control panel 7 (S16).

The predefined value H may also be determined so that the heater 16 can be soaked in the cold water supplied into the tub 10.

On the other hand, if it is determined that the water level in the tub 10 has reached the predefined value H within three minutes after the commencement of the cold water supply operation (S 14), the control unit 90 performs a heating operation (S17).

More specifically, the control unit 90 supplies power to the heater 16 so that the cold water in the tub 10 can be heated up to a predetermined temperature (for example, 30° C.) by the heater 16 (S17).

The predetermined temperature may be experimentally determined so that the frost I in the pump case 52 can easily and quickly melt away.

As the heating operation proceeds, the temperature of the cold water in the tub 10 gradually increases, and the temperature of the warm water in the pump case 52 also gradually increases due to heat conduction.

As a result, the frost I in the pump case 52 can be easily melted by the heated water in the pump case 52.

During or after operation S17, a water discharge operation may be performed (S18).

In this embodiment, operation S18 is performed after operation S17, i.e., after the cut-off of power to the heater 16.

More specifically, the control unit 90 supplies power to the discharge pump 54 (particularly, the motor 54*a*) for, for example, twenty seconds (S18).

If the frost in the pump case 52 is completely melted away by the heated water in the tub 10, the impeller 54*b* may be able to rotate without being restrained by the frost I. Thus, the impeller 54*b* pumps out the melting frost so that the melting frost can be discharged from the tub 10 though the water discharge bellows tube 48 (S18).

On the other hand, if the frost I in the pump case 52 still remains yet to be melted, the rotation of the impeller 54*b* may be restricted by the frost I. As a result, the water in the tub 10 may not be able to be discharged, and thus, the water level in the tub 10 may not decrease at all.

If it is determined that the water level in the tub 10 still has not yet decreased even after operation S18, operations S20 and S18 may be performed repeatedly.

Whenever operation S20 is performed, a target temperature of the heater 16 may be increased by 10° C. The target temperature of the heater 16 may be gradually increased up to, for example, a maximum of 95° C.

By performing operations S20 and S18 repeatedly, the frost I in the pump case 52 can be completely melted away. Thus, the impeller 54*b* may pump out the melting frost so that the melting frost can be discharged from the tub 10 through the water discharge bellows tube 48, and that the water level in the tub 10 can decrease.

If it is determined that the water level in the tub 10 has decreased (S19), the control unit 90 completes the water discharge operation (S21), and notifies the user of the completion of the defrost operation with the aid of a display device (such as an LED or an LCD) or an acoustic device (such as a buzzer or a speaker) of the control panel 7 (S22).

On the other hand, if it is determined that the water level in the tub 10 has reached the predefined value H within three minutes after the commencement of the warm water supply operation (S12), the frost I in the pump case 52 may be melted by the warm water supplied into the tub 10, as performed in the embodiment of FIG. 3. In other words, if it is determined that the water level in the tub 10 has reached the predefined value H within three minutes after the commencement of the warm water supply operation (S12), the control unit 90 performs a water discharge operation (S23).

More specifically, the control unit 90 performs the water discharge operation by supplying power to the water discharge pump 54 (particularly, the motor 54*a*) for, for example, twenty seconds (S23).

If the frost I in the pump case 52 is completely melted away by the warm water supplied into the tub 10, the impeller 54*b* may be able to rotate without being restrained by the frost I. Thus, the impeller 54*b* pumps out the warm water in the tub 10 along with the melting frost so that the warm water in the tub 10 can be discharged through the water discharge bellows tube 48 (S23).

As the water discharge operation proceeds, the water level in the tub 10 gradually decreases. The water level sensor 86 detects the water level in the tub 10 again, and outputs the result of the detection to the control unit 90. Then, the control unit 90 completes the water discharge operation (S21) if it is determined that the water level in the tub 10 has decreased (S19).

Thereafter, the control unit 90 notifies the user that the defrost operation has been completed with the aid of a display device (such as an LED or an LCD) or an acoustic device (such as a buzzer or a speaker) of the control panel 7 (S22).

On the other hand, if the frost I in the pump case 52 still remains yet to be melted, the rotation of the impeller 54*b* may still be restricted by the frost I. Thus, the warm water in the tub 10 may not be able to be discharged properly, and thus, the water level in the tub 10 may not decrease at all.

If it is determined that the water level in the tub 10 has not yet decreased, the control unit 90 may perform an additional heating operation (S25) and an additional water discharge operation (S26). Operations S25 and S26 may be performed repeatedly until the water level in the tub 10 decreases.

By performing operations S25 and S26 repeatedly, the frost I in the pump case 52 can be completely melted away. Thus, the impeller 54*b* may pump out the melting frost so that the melting frost can be discharged from the tub 10 through the water discharge bellows tube 48, and that the water level in the tub 10 can decrease.

If it is determined that the water level in the tub 10 has decreased (S24), the control unit 90 completes the additional water discharge operation (S21), and notifies the user of the completion of the defrost operation with the aid of a display device (such as an LED or an LCD) or an acoustic device (such as a buzzer or a speaker) of the control panel 7 (S22).

Figure 5:
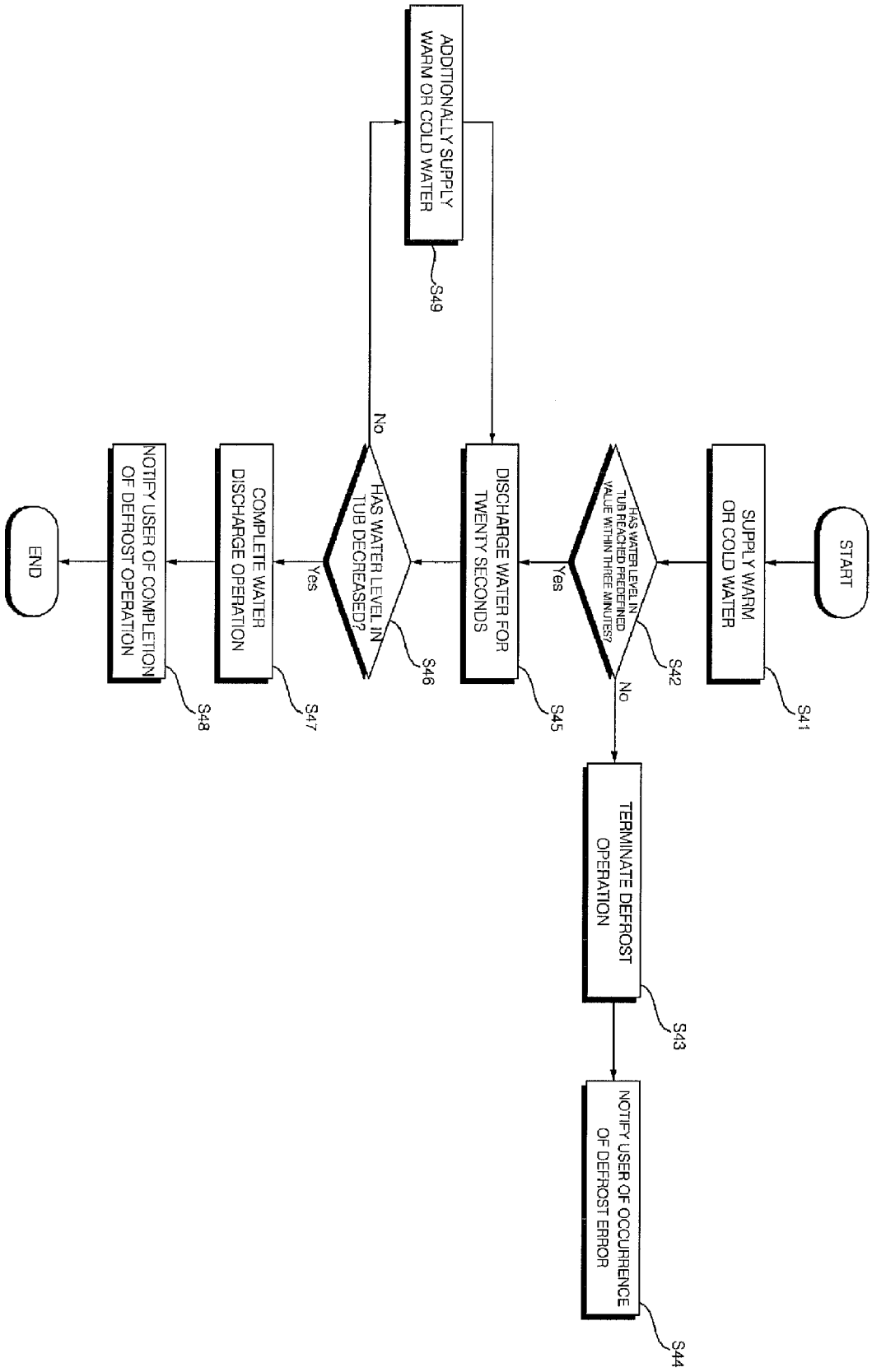
FIG. 5 is a flowchart illustrating a defrosting method of a drum-type washing machine, according to another embodiment of the present invention

FIG. 5 is a flowchart illustrating a defrosting method of a drum-type washing machine, according to another embodiment of the present invention. Referring to FIG. 5, the defrosting method includes performing a warm water supply operation (S41) and performing a water discharge operation (S45).

Referring to FIG. 5, the control unit 90 performs a warm water supply operation by turning on the water supply valves 41 (particularly, the warm water supply valve) upon receiving a defrost command from a user so that warm water can be supplied into the tub 10 via the warm water supply valve (S41).

During the warm water supply operation, the water level sensor 86 may detect the water level in the tub 10, and output the detected water level to the control unit 90. The control unit 90 determines whether the water level in the tub 10 has reached a predefined value H within, for example, three minutes, after the commencement of the warm water supply operation (S42). If it is determined that the water level in the tub 10 has reached the predefined value H within three minutes after the commencement of the warm water supply operation, the control unit 90 completes the warm water supply operation.

The predefined value H may be determined so that the heater 16 can be soaked in the warm water supplied into the tub 10.

Frost I in the pump case 52 may be melted by warm water supplied into the pump case 52 during the warm water supply operation.

On the other hand, if it is determined that the water level in the tub 10 has not reached the predefined value H within three minutes after the commencement of the warm water supply operation (S42), the control unit 90 determines that the warm water supply operation has not been properly performed, and terminates an entire defrost operation (S43). Then, the control unit 90 notifies the user of the occurrence of a defrost error using a display device (such as a light emitting diode (LED) or a liquid crystal display (LCD)) or an acoustic device (such as a buzzer or a speaker) of the control panel 7 (S44).

If it is determined that the water level in the tub 10 has reached the predefined value H within three minutes after the commencement of the warm water supply operation (S42), the control unit 90 performs a water discharge operation (S45).

More specifically, the control unit 90 performs the water discharge operation by supplying power to the water discharge pump 54 (particularly, the motor 54*a*) for, for example, twenty seconds (S45).

If the frost I in the pump case 52 is completely melted away by the warm water supplied into the tub 10, the impeller 54*b* may be able to rotate without being restrained by the frost I. Thus, the impeller 54*b* pumps out the warm water in the tub 10 along with the melting frost so that the warm water in the tub 10 can be discharged through the water discharge bellows tube 48 (S45).

As the water discharge operation proceeds, the water level in the tub 10 gradually decreases. The water level sensor 86 detects the water level in the tub 10 again, and outputs the result of the detection to the control unit 90. Then, the control unit 90 completes the water discharge operation (S47) if it is determined that the water level in the tub 10 has decreased (S46).

Thereafter, the control unit 90 notifies the user that the defrost operation has been completed with the aid of a display device (such as an LED or an LCD) or an acoustic device (such as a buzzer or a speaker) of the control panel 7 (S48).

On the other hand, if the frost I in the pump case 52 still remains yet to be melted, the rotation of the impeller 54*b* may still be restricted by the frost I. Thus, the warm water in the tub 10 may not be able to be discharged properly, and thus, the water level in the tub 10 may not decrease at all. In this case, the control unit 90 performs an additional warm water supply operation (S49).

More specifically, the control unit 90 may perform the additional warm water supply operation by turning on the warm water supply valve for, for example, one minute, or by turning on the warm water supply valve until the water level in the tub 10 reaches a predetermined value.

Due to the additional warm water supply operation, the temperature of the warm water in the tub 10 may further increase, and the frost I in the pump case 52 may easily melt away.

Operations S45, S46, and S49 may be performed repeatedly until the water level in the tub 10 decreases.

If it is determined that the water level in the tub 10 has decreased (S46) after the additional warm water supply operation, the control unit 90 completes the additional warm water supply operation (S47), and notifies the user of the completion of the defrost operation with the aid of a display device (such as an LED or an LCD) or an acoustic device (such as a buzzer or a speaker) of the control panel 7 (S48).

The defrosting method illustrated in FIG. 5, unlike the defrosting method illustrated in FIG. 3, does not include any heating operation. Thus, the defrosting method illustrated in FIG. 5 may be applied to drum-type washing machines equipped with no heaters, and may be able to reduce the power consumption of drum-type washing machines by not including any heating operation.

Figure 6:
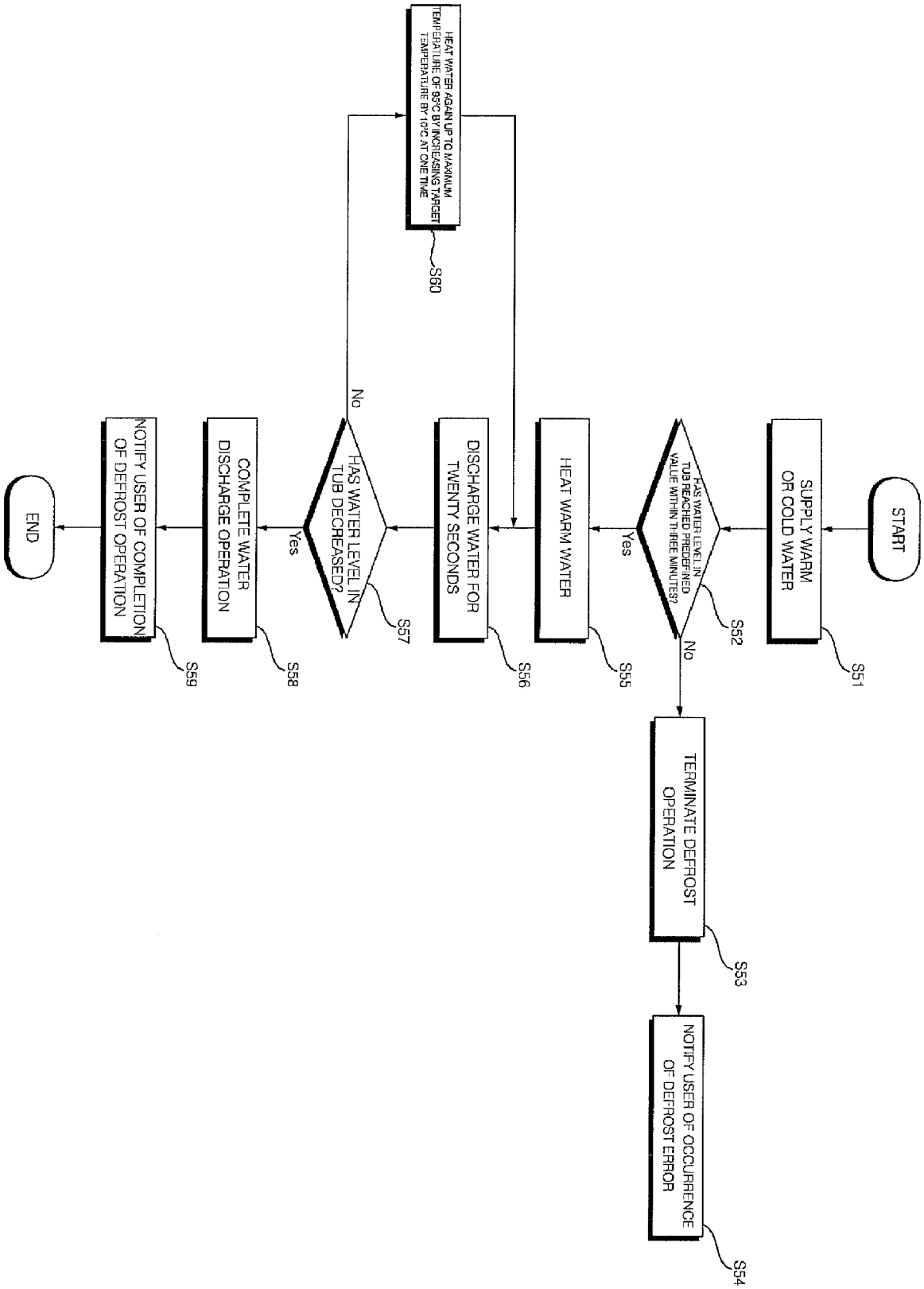
FIG. 6 is a flowchart illustrating a defrosting method of a drum-type washing machine, according to another embodiment of the present invention.

FIG. 6 is a flowchart illustrating a defrosting method of a drum-type washing machine, according to another embodiment of the present invention. Referring to FIG. 6, the defrosting method includes performing a warm water supply operation (S51), performing a heating operation (S55), and performing a water discharge operation (S56).

Referring to FIG. 6, the control unit 90 performs a warm water supply operation upon receiving a defrost command from a user (S51).

More specifically, the control unit 90 performs the warm water supply operation by turning on the water supply valves 41 (particularly, the warm water supply valve) in response to the defrost command so that warm water can be supplied into the tub 10 via the warm water supply valve (S51).

Operation S51 is the same as operation S1 of FIG. 3, and the result of operation S51 is the same as that of operation S1 of FIG. 3. Thus, a detailed description of operation S51 will be skipped.

The control unit 90 determines whether the water level in the tub 10 has reached a predefined value H within, for example, three minutes, after the commencement of the warm water supply operation (S52). If it is determined that the water level in the tub 10 has not reached the predefined value H within three minutes after the commencement of the warm water supply operation, the control unit 90 determines that the warm water supply operation has not been properly performed, and terminates an entire defrost operation (S53). Then, the control unit 90 notifies the user of the occurrence of a defrost error using a display device (such as a light emitting diode (LED) or a liquid crystal display (LCD)) or an acoustic device (such as a buzzer or a speaker) of the control panel 7 (S54).

If it is determined that the water level in the tub 10 has reached the predefined value H within three minutes after the commencement of the warm water supply operation (S52), the control unit 90 performs a heating operation (S55).

More specifically, the control unit 90 performs the heating operation, instead of a water discharge operation, by supplying power to the heater 16 so that the warm water in the tub 10 can be heated up to a predetermined temperature, for example, a temperature of 65° C., by the heater 16.

The predetermined temperature may be experimentally determined so that the frost I in the pump case 52 can easily and quickly melt away.

Operation S55 is the same as operation S9 of FIG. 3, and the result of operation S55 is the same as the result of operation S9 of FIG. 3. Thus, a detailed description of operation S55 will be skipped.

After the heating operation, the control unit 90 performs a water discharge operation (S56).

More specifically, the control unit 90 performs the water discharge operation by supplying power to the water discharge pump 54 (particularly, the motor 54*a*) for, for example, twenty seconds (S56).

If the frost I in the pump case 52 is completely melted away by the warm water supplied into the tub 10, the impeller 54*b* may be able to rotate without being restrained by the frost I. Thus, the impeller 54*b* pumps out the warm water in the tub 10 along with the melting frost so that the warm water in the tub 10 can be discharged through the water discharge bellows tube 48 (S56).

On the other hand, if the frost I in the pump case 52 still remains yet to be melted, the rotation of the impeller 54*b* may still be restricted by the frost I. Thus, the warm water in the tub 10 may not be able to be discharged properly, and thus, the water level in the tub 10 may not decrease at all.

If it is determined that the water level in the tub 10 has not yet decreased, the control unit 90 may perform an additional heating operation (S60) and the water discharge operation (S56) repeatedly.

Whenever operations S60 and S56 are performed, a target temperature of the heater 16 may be increased by 10° C. The target temperature of the heater 16 may be gradually increased up to, for example, a maximum of 95° C.

By performing operations S60 and S56 repeatedly, the frost I in the pump case 52 can be completely melted away. Thus, the impeller 54*b* may pump out the melting frost without being restrained by the frost I so that the melting frost can be discharged from the tub 10 through the water discharge bellows tube 48, and that the water level in the tub 10 can decrease.

If it is determined that the water level in the tub 10 has decreased (S57), the control unit 90 completes the water discharge operation (S58), and notifies the user of the completion of the defrost operation with the aid of a display device (such as an LED or an LCD) or an acoustic device (such as a buzzer or a speaker) of the control panel 7 (S59).

Figure 7:
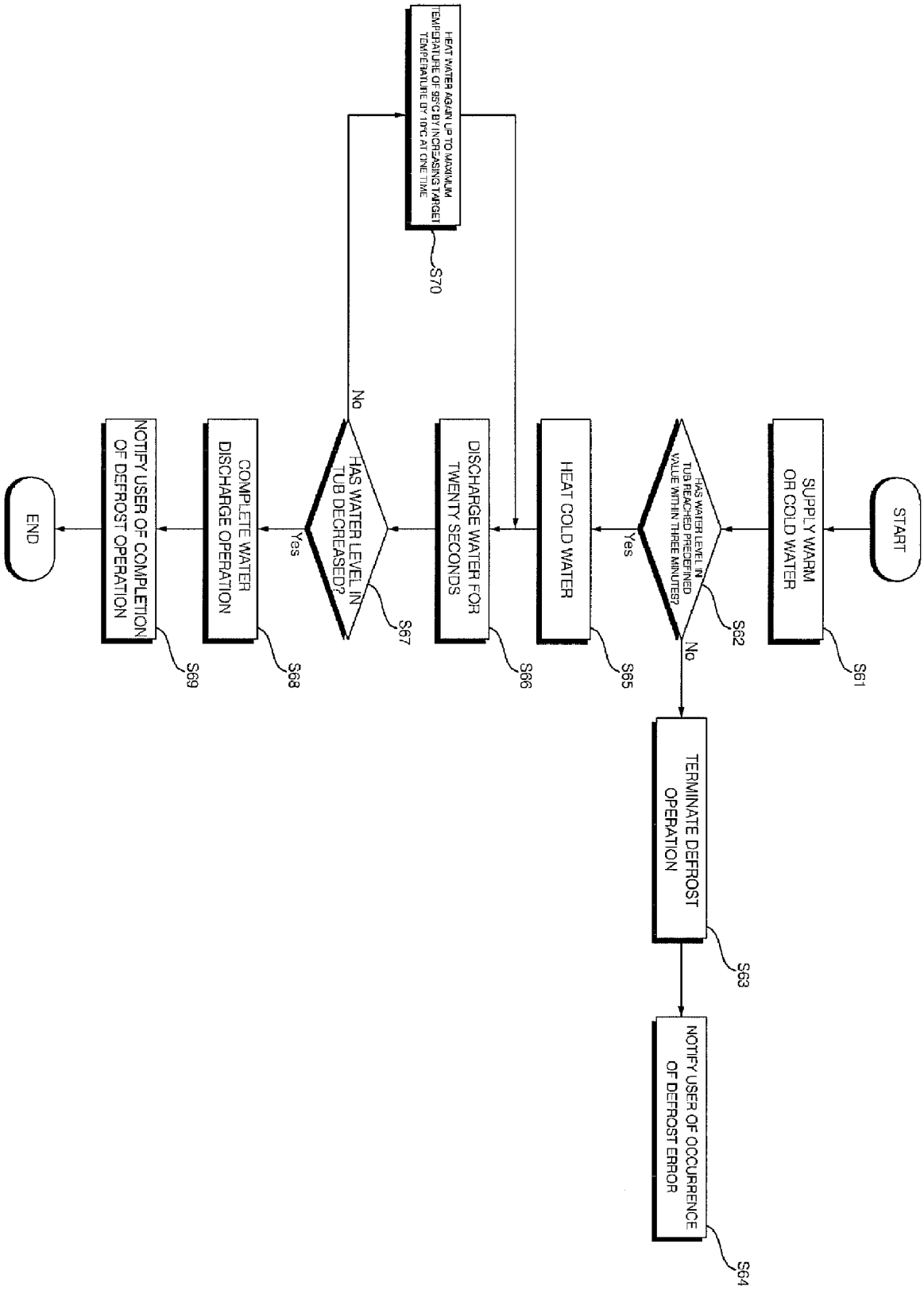
FIG. 7 is a flowchart illustrating a defrosting method of a drum-type washing machine, according to another embodiment of the present invention.

FIG. 7 is a flowchart illustrating a defrosting method of a drum-type washing machine, according to another embodiment of the present invention. Referring to FIG. 7, the defrosting method includes performing a cold water supply operation (S61), performing a heating operation (S65), and performing a water discharge operation (S66).

Referring to FIG. 7, the control unit 90 performs a cold water supply operation upon receiving a defrost command from a user (S61).

More specifically, the control unit 90 performs the cold water supply operation by turning on the water supply valves 41 (particularly, the cold water supply valve) in response to the defrost command so that cold water can be supplied into the tub 10 via the warm water supply valve (S61).

As a result of the cold water supply operation, the pump case 52 becomes increasingly filled with the cold water supplied into the tub 10.

Thereafter, the control unit 90 determines whether the water level in the tub 10 has reached a predefined value H within, for example, three minutes, after the commencement of the cold water supply operation (S62). If it is determined that the water level in the tub 10 has not reached the predefined value H within three minutes after the commencement of the cold water supply operation, the control unit 90 determines that the cold water supply operation has not been properly performed, and terminates an entire defrost operation (S63). Then, the control unit 90 notifies the user of the occurrence of a defrost error using a display device (such as a light emitting diode (LED) or a liquid crystal display (LCD)) or an acoustic device (such as a buzzer or a speaker) of the control panel 7 (S64).

The predetermined value H may be determined so that the heater 16 can be soaked in the cold water supplied into the tub 10.

If it is determined that the water level in the tub 10 has reached the predefined value H within three minutes after the commencement of the cold water supply operation (S62), the control unit 90 performs a heating operation (S65).

More specifically, the control unit 90 performs the heating operation by supplying power to the heater 16 so that the cold water in the tub 10 can be heated up to a predetermined temperature, for example, a temperature of 30° C., by the heater 16 (S65).

As the heating operation proceeds, the temperature of the cold water in the tub 10 gradually increases, and the temperature of the warm water in the pump case 52 also gradually increases due to heat conduction. Thus, the frost I in the pump case 52 may easily melt away.

During or after the heating operation, the control unit 90 may perform a water discharge operation (S66). In this embodiment, operation S10 is performed after operation S65, i.e., after the cut-off of power to the heater 16.

More specifically, the control unit 90 performs the water discharge operation by supplying power to the water discharge pump 54 (particularly, the motor 54*a*) for, for example, twenty seconds (S66).

If the frost I in the pump case 52 is completely melted away by the warm water supplied into the tub 10, the impeller 54*b* may be able to rotate without being restrained by the frost I. Thus, the impeller 54*b* pumps out the melting frost so that the melting frost can be discharged through the water discharge bellows tube 48 (S66).

On the other hand, if the frost I in the pump case 52 still remains yet to be melted, the rotation of the impeller 54*b* may still be restricted by the frost I. Thus, the water in the tub 10 may not be able to be discharged properly, and thus, the water level in the tub 10 may not decrease at all.

If it is determined that the water level in the tub 10 has not yet decreased, the control unit 90 may perform an additional heating operation (S70) and the water discharge operation (S66) repeatedly.

Whenever operations S70 is performed, a target temperature of the heater 16 may be increased by 10° C. The target temperature of the heater 16 may be gradually increased up to, for example, a maximum of 95° C.

By performing operations S70 and S66 repeatedly, the frost I in the pump case 52 can be completely melted away. Thus, the impeller 54*b* may pump out the melting frost without being restrained by the frost I so that the melting frost can be discharged from the tub 10 through the water discharge bellows tube 48, and that the water level in the tub 10 can decrease.

If it is determined that the water level in the tub 10 has decreased (S67), the control unit 90 completes the water discharge operation (S68), and notifies the user of the completion of the defrost operation with the aid of a display device (such as an LED or an LCD) or an acoustic device (such as a buzzer or a speaker) of the control panel 7 (S69).

The defrosting method of a drum-type washing machine according to the present invention can provide the following advantages.

First, according to the present invention, it is possible to quickly defrost a drum-type washing machine, and particularly, a pump casing by performing a warm water supply operation and a water discharge operation and, if the water level in a tub has not yet decreased, performing a heating operation and an additional water discharge operation. Therefore, there is no need for a user to pour boiling water into a drum of a drum-type washing machine in order to defrost the drum-type washing machine.

Second, according to the present invention, it is possible to quickly defrost a drum-type washing machine even when no warm water is available by supplying cold water, heating the cold water, and discharging the heated water.

Third, according to the present invention, it is possible to increase the reliability of a defrost operation by performing a heating operation and a water discharge operation more than one time if a drum-type washing machine is not completely defrosted by heating warm water or cold water.

Fourth, according to the present invention, it is possible to minimize the number of iterations of heating and water discharge operations and to quickly defrost a drum-type washing machine by increasing a target heating temperature by a predetermined amount whenever the heating operation is performed.

Fifth, according to the present invention, it is possible to quickly defrost a drum-type washing machine by supplying warm water, heating the warm water, and discharging the heated water.

Sixth, according to the present invention, it is possible to maximize user convenience by allowing a user to input a defrost command to a drum-type washing machine with the use of one or more buttons provided on a control panel of the drum-type washing machine and allowing the drum-type washing machine to automatically perform a defrost operation in response to the defrost command.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A defrosting method of a drum-type washing machine, the defrosting method comprising:

performing a warm water supply operation upon receiving a defrost command, comprising opening a warm water supply valve and supplying warm water into a tub of the washing machine so that the supplied warm water flows into a pump case that is connected to the tub;

detecting a water level in the tub using a water level sensor; and if the detected water level has reached a predetermined value within a predetermined amount of time after commencement of the warm water supply operation, performing a water discharge operation so that the warm water in the tub is discharged through the pump case.

2. The defrosting method of claim 1, further comprising:

detecting a water level in the tub after performing the water discharge operation, and if the detected water level has not yet decreased after performing the water discharge operation, performing a heating operation; and performing an additional water discharge operation during the heating operation or after the heating operation is completed.

3. The defrosting method of claim 2, wherein the predetermined value corresponds to a water level in the tub at which a heater is submerged in warm water supplied during the warm water supply operation.

4. The defrosting method of claim 2, wherein performing an additional water discharge operation comprises performing the additional water discharge operation for a predefined amount of time.

5. The defrosting method of claim 2, further comprising performing the heating operation and the additional water discharge operation repeatedly if the water level has not yet decreased.

6. The defrosting method of claim 5, wherein performing the heating operation and the additional water discharge operation repeatedly comprises increasing a target heating temperature by a predefined amount each time the heating operation is performed.

7. The defrosting method of claim 6, wherein increasing the target heating temperature comprises increasing the target heating temperature up to a predefined maximum temperature.

8. The defrosting method of claim 1, further comprising:

if the water level in the tub has not reached the predetermined value within the predefined amount of time after commencement of the warm water supply operation, performing a cold water supply operation, comprising opening a cold water supply valve and supplying cold water into the tub so that the supplied cold water flows into the pump case; and if the water level has reached the predetermined value within a predefined amount of time after commencement of the cold water supply operation, performing a heating operation, and performing the water discharge operation after performing the heating operation.

9. The defrosting method of claim 8, wherein the predetermined value corresponds to a water level in the tub at which a heater is submerged in water supplied during either the warm water supply operation or the cold water supply operation.

10. The defrosting method of claim 8, further comprising, after performing the water discharge operation, providing notification of completion of a defrost operation if a water level in the tub has decreased.

11. The defrosting method of claim 8, further comprising performing the heating operation and the water discharge operation repeatedly if the water level has not yet decreased.

12. The defrosting method of claim 11, further comprising, after performing the heating operation and the water discharge operation repeatedly, providing notification of completion of a defrost operation if the water level has decreased.

13. The defrosting method of claim 11, wherein performing the heating operation and the water discharge operation repeatedly comprises increasing a target heating temperature by a predefined amount each time the heating operation is performed.

14. The defrosting method of claim 13, wherein increasing the target heating temperature comprises increasing the target heating temperature up to a predefined maximum temperature.

15. The defrosting method of claim 8, further comprising, if the water level has not reached the predetermined value within the predefined amount of time after commencement of the cold water supply operation, providing notification of occurrence of a defrost error.

16. The defrosting method of claim 1, further comprising providing notification of completion of a defrost operation if the water level has decreased after performing the water discharge operation.

* * * * *